United States Patent [19]

Hirai

[11] 3,969,850

[45] July 20, 1976

[54] METAL ROOF CONSTRUCTION

[75] Inventor: Takashi Hirai, Ukita, Japan

[73] Assignee: Kabushiki Kaisha Hirai Giken, Tokyo, Japan

[22] Filed: Feb. 27, 1975

[21] Appl. No.: 553,507

[30] Foreign Application Priority Data

| | | |
|---|---|---|
| Apr. 17, 1974 | Japan | 49-42323 |
| Nov. 26, 1974 | Japan | 49-135127 |
| Jan. 18, 1975 | Japan | 50-8245 |

[52] U.S. Cl. ..... 52/97; 52/404; 52/531

[51] Int. Cl.[2] ..... E04D 13/00; E04B 1/74

[58] Field of Search ..... 52/97, 404, 531

[56] References Cited

UNITED STATES PATENTS

| | | | |
|---|---|---|---|
| 3,135,070 | 6/1964 | Waring et al. | 52/97 X |
| 3,290,845 | 12/1966 | Snyder | 52/404 X |
| 3,341,999 | 10/1967 | Berg | 52/404 X |
| 3,486,281 | 12/1969 | Gregoire | 52/404 X |
| 3,488,905 | 1/1970 | Campbell | 52/404 X |

*Primary Examiner*—J. Karl Bell

[57] ABSTRACT

A metal roof unit including a backing, a heat insulating material, and a surface metal plate, which can be produced by roll forming, press forming or extrusion forming on a mass-production basis in factories and can be used for roofing without special skill by expert roofers. In order to unite the metal roof units there are provided joint members which can be produced of light metal such as aluminum by roll forming, press forming or extrusion forming. The joint members are provided with a series of slits from which nails are driven through notches provided at each ends of said metal roof units into a rafter which is provided under said metal roof units, and said slits and notches have sufficient allowance in order to make the joint members and metal roof units movable by heat expansion due to sun heat.

4 Claims, 21 Drawing Figures

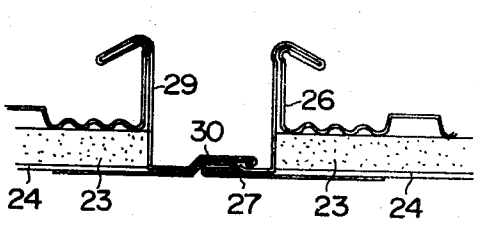
FIG. 5a
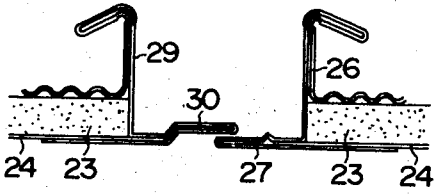
FIG. 5b
FIG. 5c
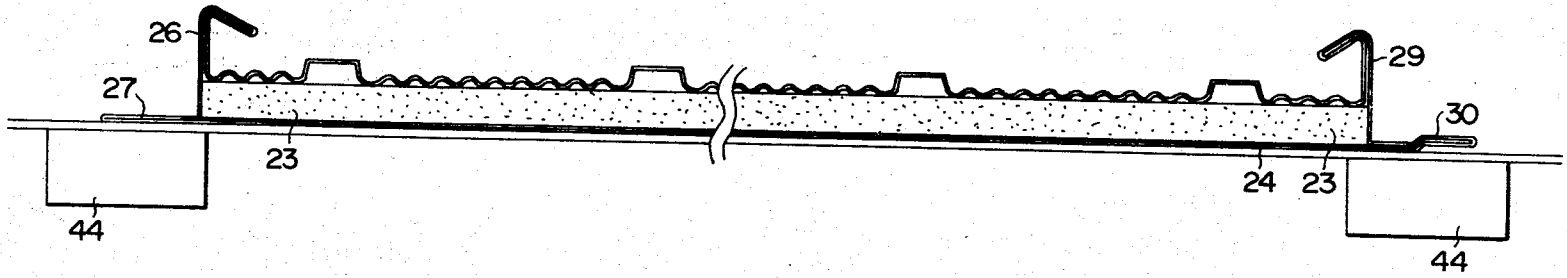
FIG. 5d

METAL ROOF CONSTRUCTION

BACKGROUND OF THE INVENTION

1. Field of the Invention

This invention relates to a novel metal roof unit of a unitary box-like structure comprising a backing, a surface metal plate, a heat insulating material disposed integrally between the backing and the metal plate, and a joint member provided along its longitudinal direction.

2. Description of the Prior Art

Conventional roofing materials include, for example, clay rooftile, galvanized sheet iron, pressed cement rooftile and cement rooftile. However, all of these are only materials for roof covering, and in actual roofing works, roofers use such a material together with separately provided other roofing materials, a heat insulating material and a water-proof device and lay roofs with their special skill and great efforts.

SUMMARY OF THE INVENTION

It is an object of this invention to provide a metal roof unit containing a backing, a heat insulating material, a surface metal plate and a water-proof device as a unitary structure which can be produced by roll forming, press forming or extrusion forming on a mass-production basis in factories and can be used for roofing without a special expert skill.

After production in factories, such roof units are adjusted to predetermined sizes on the ground, and then used for roofing. Only a simple work of joining and nailing is required for roofing using these units, and even the layman can lay roofs using these units. Since the roofing operation using the metal roof units of this invention is so simple, the time required for roofing can be greatly shortened.

Figure 6:
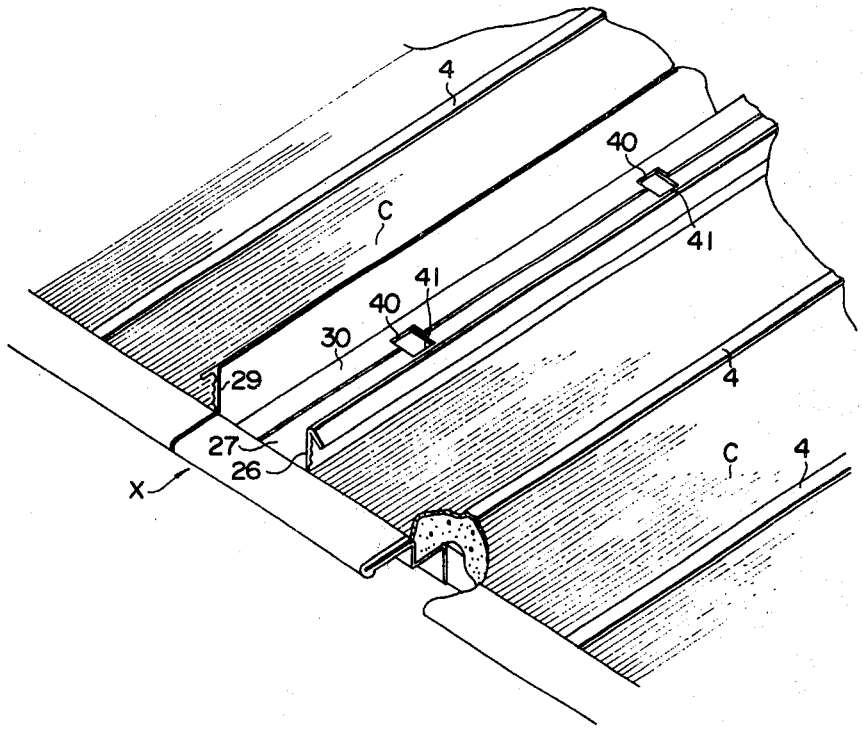
Figure 7:
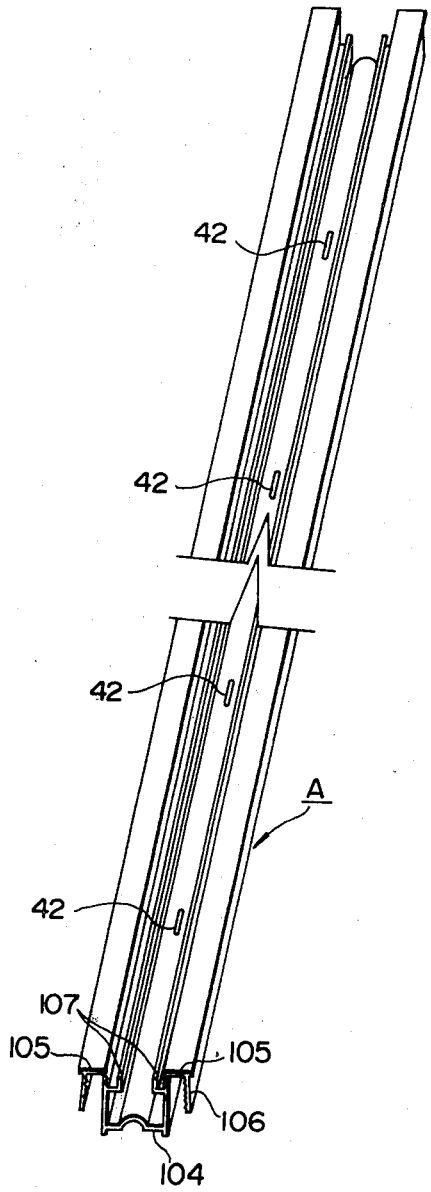
Figure 8:
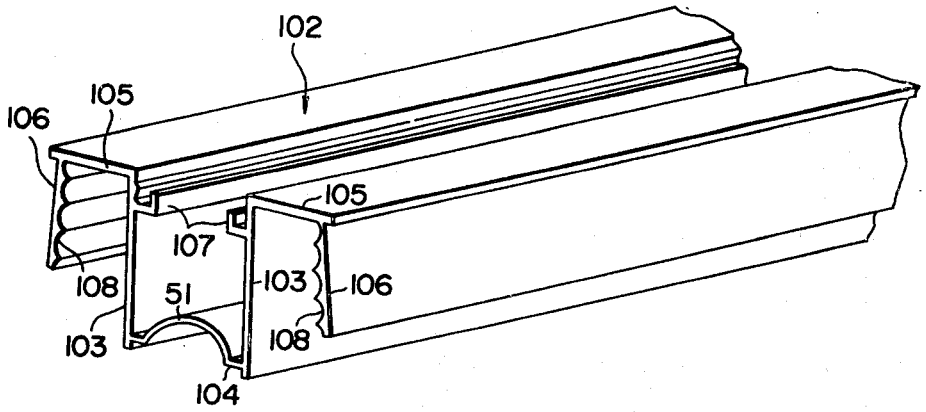
Figure 9:
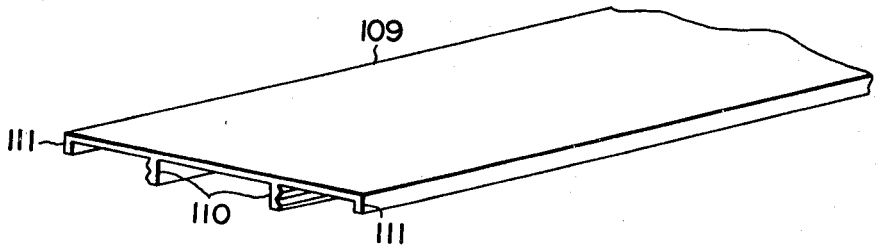
Figure 10:
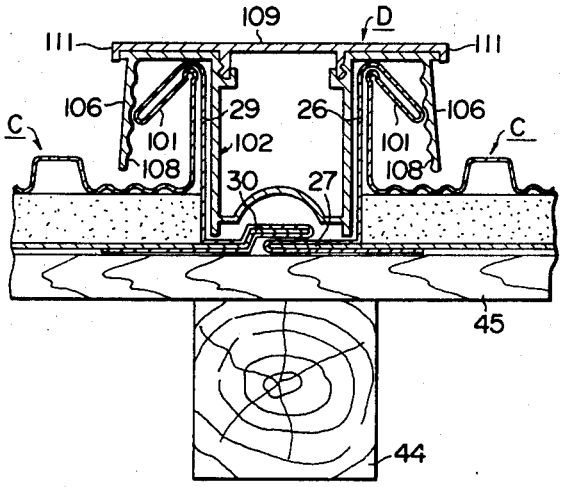
Figure 11:
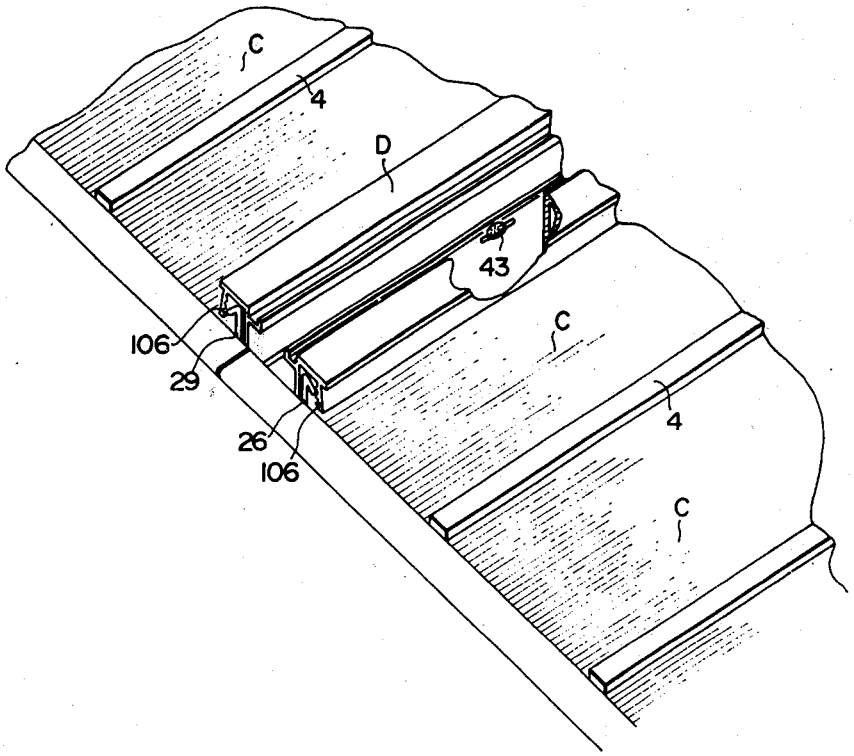
Figure 12:
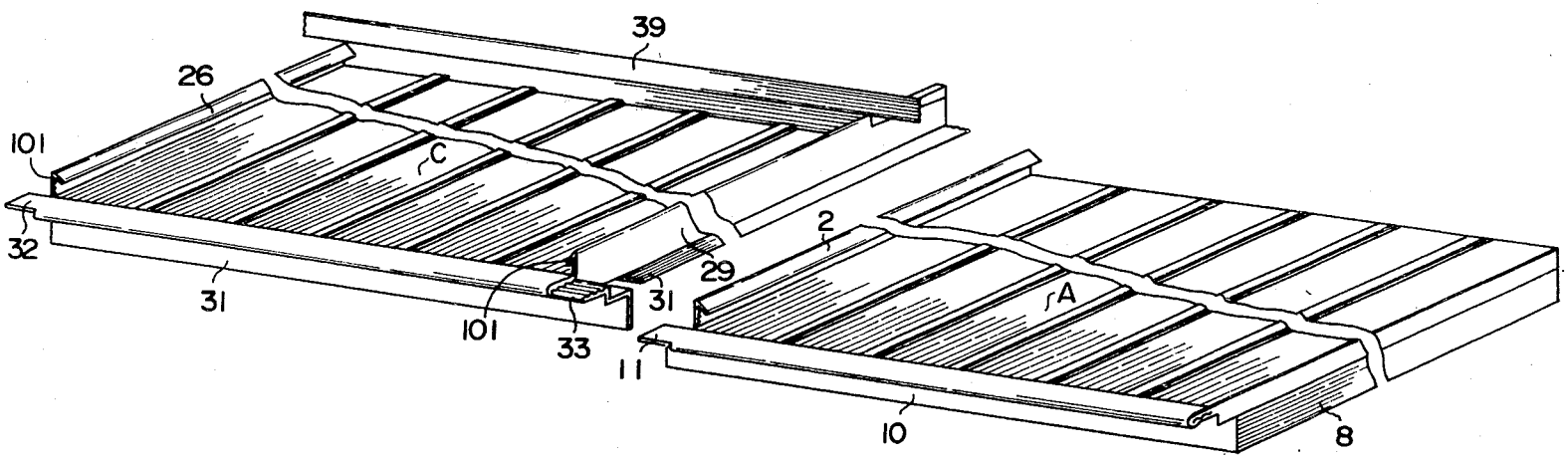
Figure 13:
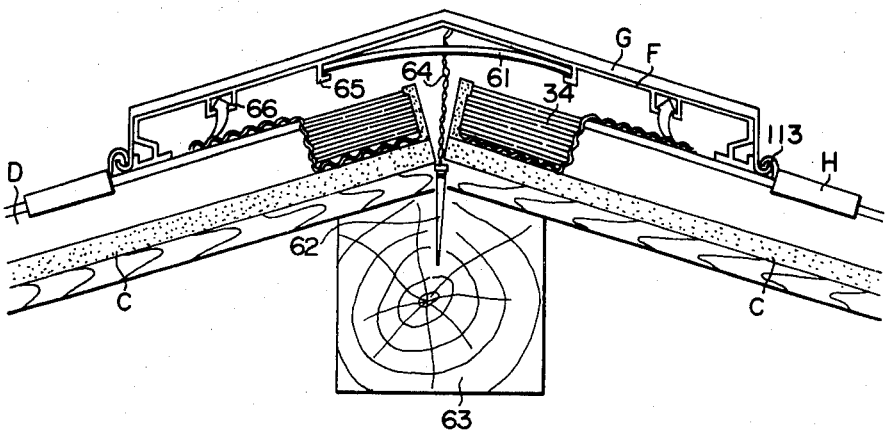
Figure 14:
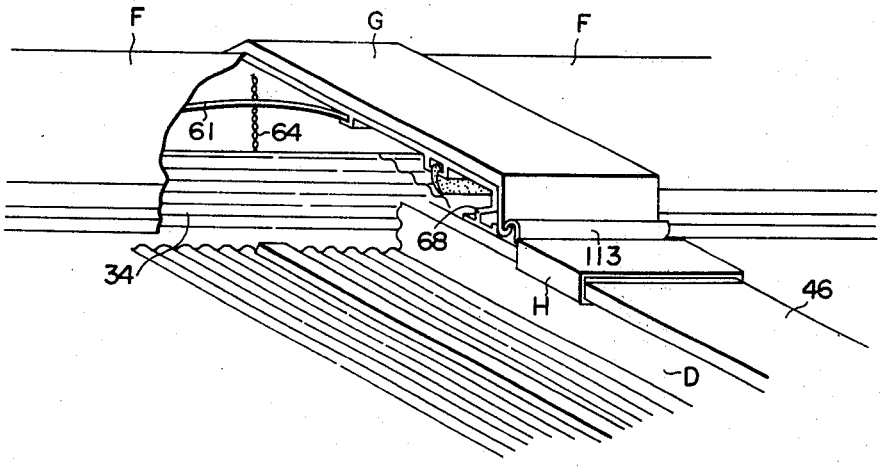
Figure 15:
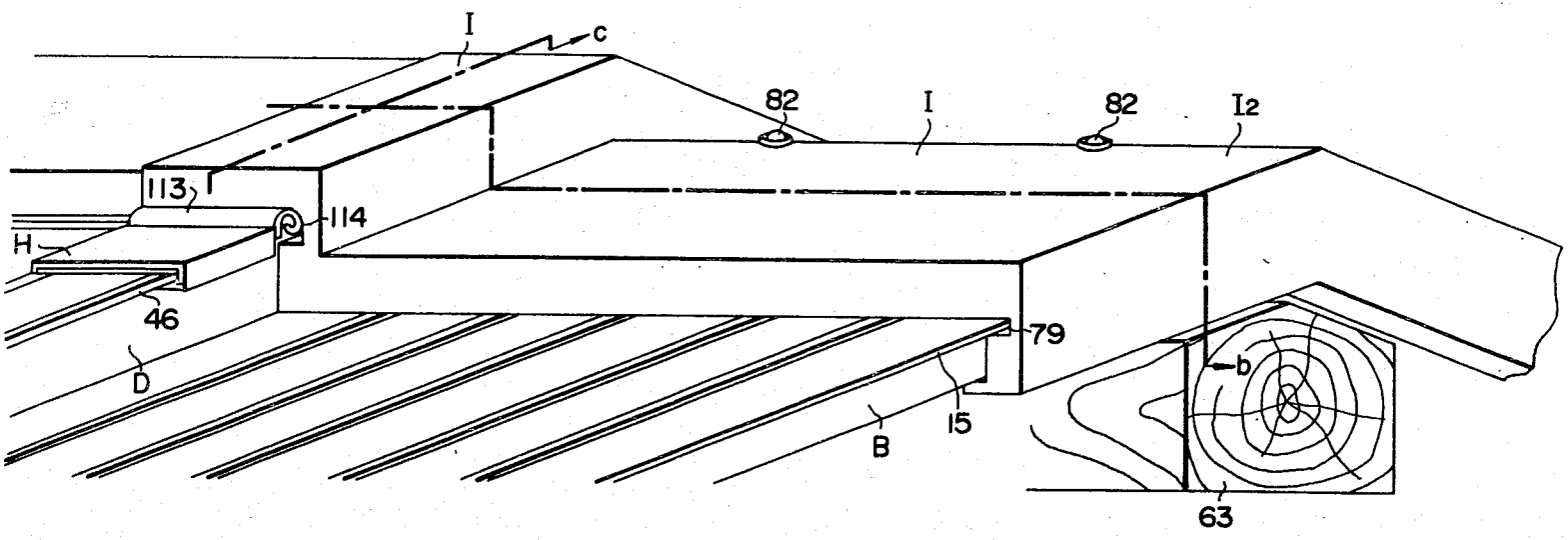
Figure 16:
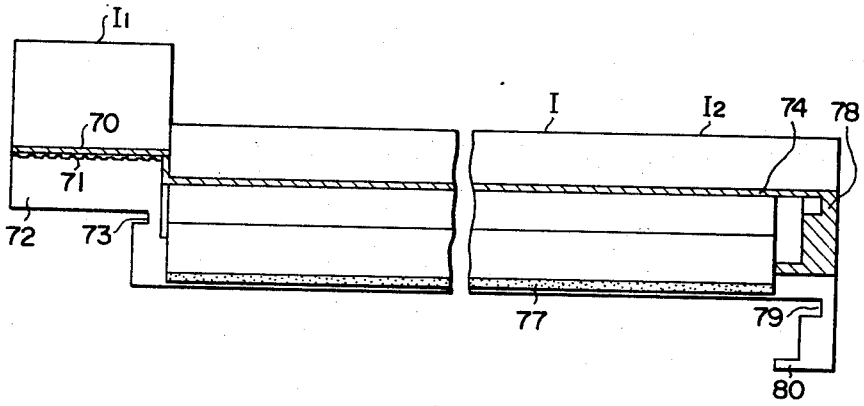
Figure 17:
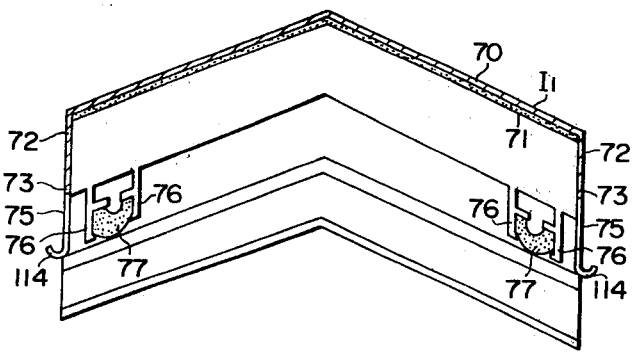

FIGS. *5a*, *5b*, and *5c* are sectional views of ways of joining roof units C to each other, FIG. *5d* is a cross sectional view of roof unit C;

FIG. 6 is a perspective view showing the metal roof units C joined with each other;

FIGS. 7 and 8 are perspective views of a joint member D;

FIG. 9 is a perspective view of a covering member of the joint member D;

FIG. 10 is a cross sectional view showing united ends of metal roof units C with joint member D;

FIG. 11 is a perspective view showing the metal roof units C joined and connected with each other by means of the joint member D;

FIG. 12 is a perspective view showing the metal roof unit C and the side metal roof unti A about to be joined;

FIG. 13 is a perspective view of the ridge portion of a roof in which ridge boards are joined with a ridge connecting member, covered with a ridge connecting cover, and fixed by a connecting cover fixing member;

FIG. 14 is a perspective view of the ridge portion shown in FIG. 13 when seen from the right side of FIG. 13;

FIG. 15 is a perspective view showing the structure of the end portion of the ridge;

FIG. 16 is a cross sectional view taken along the line b—b of FIG. 15; and FIG. 17 is a cross sectional view taken along the line c—c of FIG. 15.

DETAILED DESCRIPTION OF PREFERRED EMBODIMENTS OF THE INVENTION

The metal roof units of this invention will be described below by reference to the accompanying drawings.

Figure 1:
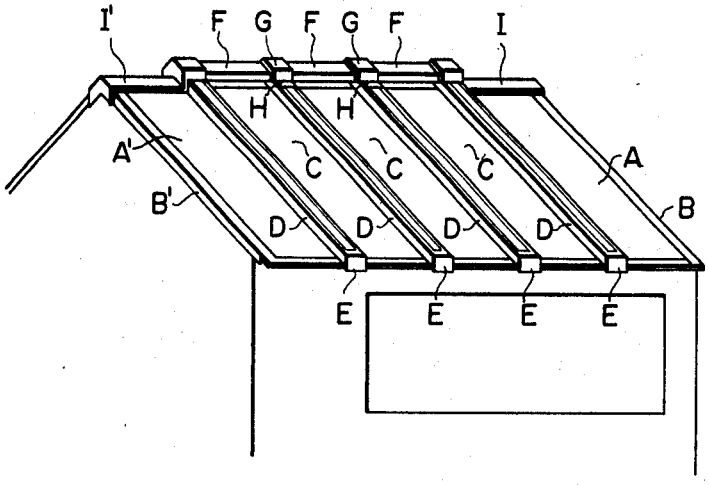
FIG. 1 is a sketch of a roof laid by using the roof unit of this invention.

Referring to FIG. 1 which shows a roof laid by using the metal roof units of this invention, A represents a side metal roof unit to be secured to one side of a roof; B shows a reinforcing material which covers the side end of the side metal roof unit A and thus protects it; and C represents a metal roof unit which is the most important roofing material that constructs the central part of a roof. A′ designates a side metal roof unit having a structure symmetrical to the side metal roof unit A laid at the right end of the roof. If the side metal roof unit A is used as the first roof unit, then the side metal roof unit A′ is used as the last roof unit. Which of the unit A or A′ should be made the first unit in roofing is free to choose. B′ represents a reinforcing member which has a structure symmetrical to the reinforcing member B and forms a protective covering on the side end part of the side metal roof unit A′. D represents a joint member which connect the side metal roof unit A or A′ to the metal roof unit C, or the metal roof units C to each other. E represents a cap which covers the front surface of the joint member D after joining the metal roof units by means of the joint member D, in order to present a good appearance of the roof. F designates a ridge board which is placed on the ridge portion of a roof laid by the metal roof units of this invention C and secured to a ridge piece. The ridge boards F are covered with a ridge connecting cover G at their joint part and secured to the joint member D by a connecting cover fixing member H. I and I′ show ridge end members which cover both ends of the ridge, and are fixed to the ridge piece in engagement with the outermost joint member D and the reinforcing member B and B′.

Figure 2:
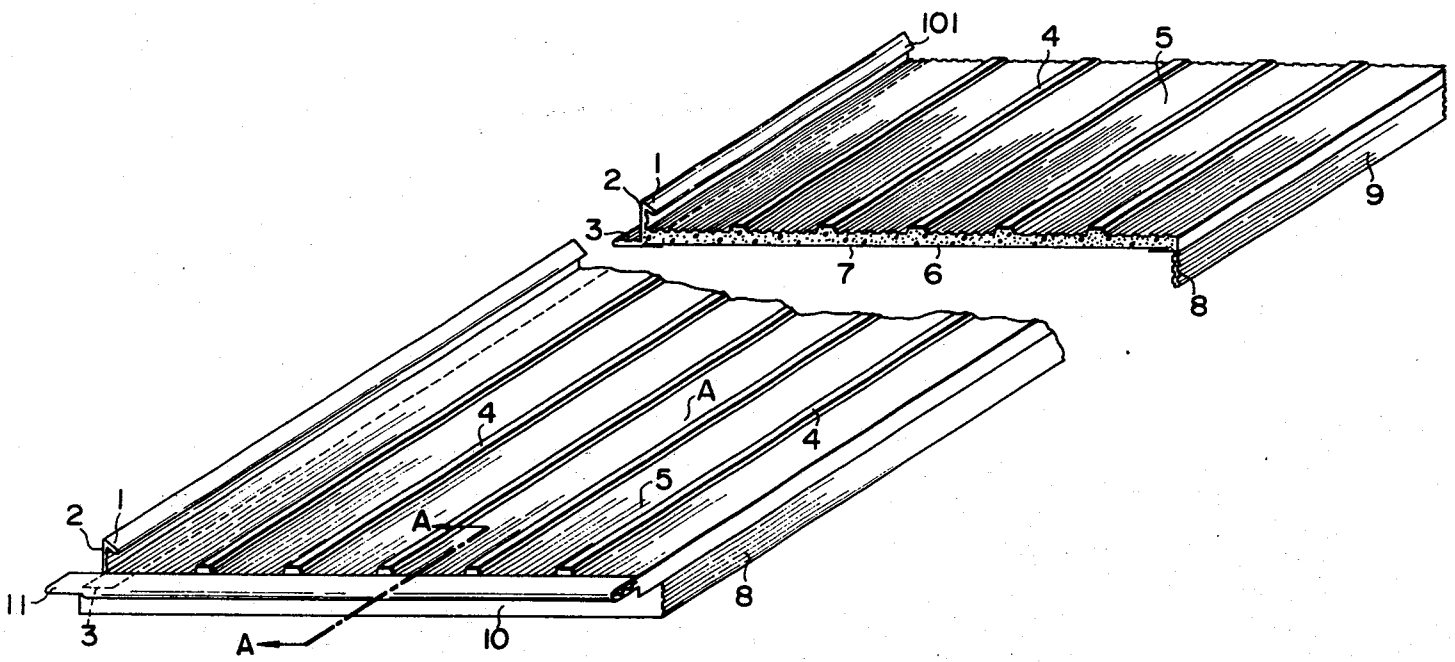
FIG. 2 is a perspective view of a side metal roof unit A.

FIG. 2 shows the side metal roof A shown in FIG. 1. This unit A includes a vertical rising portion 2 having small corrugations 1 and having a bended portion 101 and a connecting extension 3. The upper part of this unit A consists of a metal plate, such as an aluminum alloy plate, including projections 4 and small corrugations 5, and between it and a backing 7 (roofing materials, etc.) at its bottom, a heat insulating material 6 is held integrally. On the other side (the right end of FIG. 2) of the unit A, the upper metal plate is bended vertically downwards to form a downwardly bended portion 8. The downwardly bended portion 8 is bended at its lower end inwardly at right angles thereby to support the undersurface of the backing material 7. Like the connecting extension 3, the downwardly bended portion 8 holds the end portion of the backing 7 and includes small corrugations 9 on its inside and outside along its longitudinal direction. These small corrugations 9, like the small corrugations 1, have an effect of preventing the intrusion of rainwater by surface tension. An eaves member 10 is caulked to the forward end of the side roof unit A.

Figure 3:
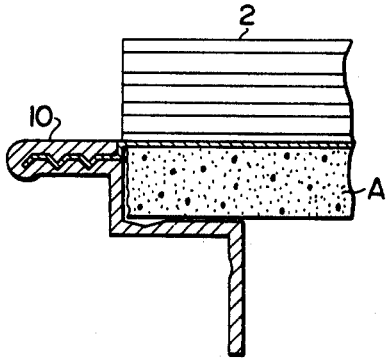
FIG. 3 is a cross sectional view taken along the line a-a of FIG. 2.

FIG. 3 shows the eaves member 10 in cross section taken along the line *a—a* of FIG. 2. A connecting portion 11 is provided in the eaves member 10 so that it can be connected in superimposed relation with the eaves member fitted to the metal roof unit C for laying the central part of the roof.

Figure 4:
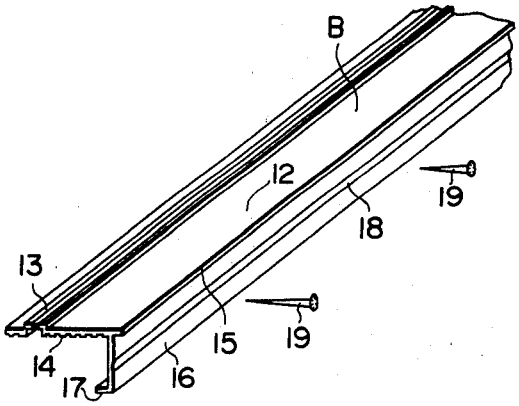
FIG. 4 is a perspective view of a reinforcing member B.

FIG. 4 shows the reinforcing material B for the side metal roof unit A. The reinforcing material B is fabricated from an aluminum alloy, etc. by extrusion, and is generally L-shaped. The upper surface 12 of the L-shaped structure is a part which is to be placed on the side metal roof unit A, and has a projection 13 to be fitted in a raised portion 4 provided at the extreme end of the side roof unit A. Furthermore, the upper surface 12 optionally includes small corrugations 14 in its inside which become engaged with the small corrugations 5 on the upper surface of the side metal roof unit A. From a position slightly inward of the outer end of the upper surface 12, an L-shaped downwardly bended portion 16 extends with a flange portion 15 left at the outer end. At the lower end of the L-shaped downwardly bended portion 16, a flange 17 extending inwardly thereof is provided. The flange portion 15 is partly a design necessity, but also has the function of fixing the ridge in engagement with a ridge end material I to be described.

When the side metal roof unit A and the reinforcing material B of the above structures are fitted to the side of a roof, the side metal roof unit A is first placed so as to cover the side portion of a roof, and the reinforcing material B is superposed on top of it, as shown in FIG. 1. Then, nails 19 are hammered from a nailing groove 18 into the rafter through the donwardly bended portion 16 of the reinforcing material B, the downwardly bended portion 8 of the roof unit A, and a barge board fixed to the rafter, etc.

Figure 5:
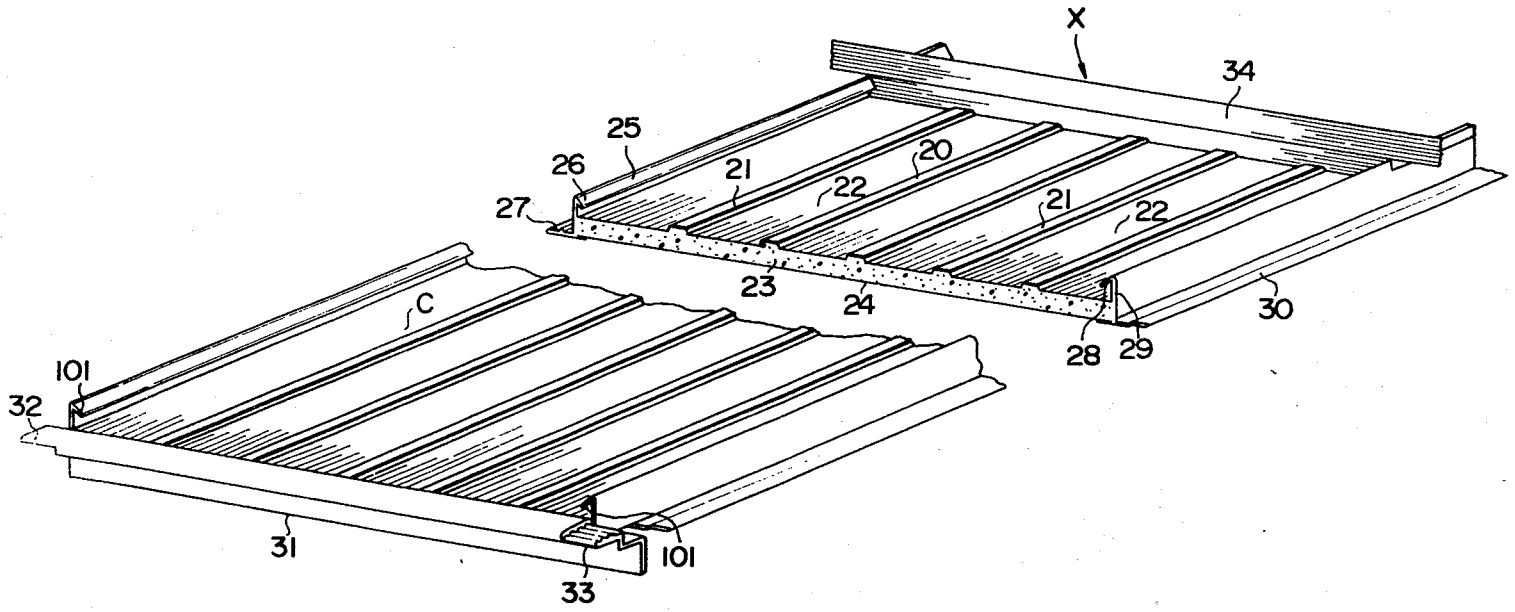
FIG. 5 is a perspective view of a roof unit C in accordance with this invention.

After one side (the right end of FIG. 1) of the roof is laid, the central part of the roof is then laid with metal roof units C as shown in FIG. 5.

The detailed structure of the metal roof unit C for constructing the central part of the roof is shown in FIG. 5. The reference numeral 20 represents a surface metal plate (generally, an aluminum alloy plate is preferred in view of its anti-corrosive property and workability) which includes raised portions 21 at equal intervals and small corrugations 22 between the raised portions 21. The raised portions 21 and the small corrugations 22 on the surface of the roof unit C serve to increase the strength of the roof unit and to facilitate the flowing of rainwater along the inclination of the roof, and are generally made by roll forming.

A heat insulating material 23 (such as glass wool or foamed resins) is disposed beneath the metal plate 20, and sandwiched between the metal plate 20 and a backing material 24 forming the bottom of the metal roof unit C.

On one side (the left end of FIG. 5) of the metal plate 20, a vertical rising portion 26 having small corrugations in its longitudinal direction and having a bended portion 101 in its end is provided integrally with the surface metal plate 20. The vertical rising portion 26 is bended back at its bended portion 101, bended at its bottom, at right angles outwardly thereof, and again bended inwardly thereof to form a connecting extension 27. The end of the backing material 24 is inserted in the space formed in the bended portion of the connection extension 27, and firmly held there by roll forming.

On the other side ( the right end of FIG. 5) of the metal plate 20, a vertical rising portion 29 including small corrugations 28 in its inside and a bended portion 101 in its end (having the same height as the vertical rising portion 26) is provided in the same way as in the left end. The vertical rising portion 29 is bended back at its bended portion 101, bended at its bottom at right angles outwardly thereof, and again bended inwardly to form a second connecting extension 30.

For clearance adjustment, one of the connecting extensions is made a little longer than the other. FIG. 5*a*, 5*b* and 5*c* show way of jointing neighbouring metal roof units C to each other. FIG. 5*a* shows a normal way of jointing while FIG. 5*b* shows a way of jointing neighbouring metal roof units C whereby the distance between those units C are provided widely, on the other hand in FIG. 5*c*, the distance between the units C are provided narrowly. FIG. 5*d* shows a cross sectional view of a metal roof unit C.

FIG. 6 shows a perspective view showing two neighbouring metal roof units C and C overlapped to each other at their connecting extensions 27 and 30. At the each end of the extended joint portion 27 and 30 there are provided a series of notches 41, 40 made by press works arranged with equal distance so that the notches 41, 40 constitute rectangular shaped holes at the overlapped connecting extensions 27 and 30 of the metal roof units C and C, when the roof according to the present invention is constructed.

FIG. 7 and FIG. 8 show perspective views of a joint member D which is to be mounted on the extended joint portions of the metal roof units C, C in order to joint them. The joint member D is generally U-shaped made of light metals such as aluminium by extrusion works. The U-shaped main body 102 includes side walls 103 and a bottom 104 located at a position just a little above the lower edges of the side walls 103. At the top of the side walls 103, flange 105 extending outwardly at right angles thereto are provided, and engaging members 106 extend downwardly in an obliquely outward direction from the underside of the flanges 105 just inwardly of their outer edges. On the inner surface of the side walls 103, projecting pieces 107 protrude to receive leg members 110 of the covering member 109. At the inside of the engaging members 106 corrugations 108 are provided in the longitudinal direction in order to prevent the inside of the roof from penetration of rain or wind.

The metal roof units are subjected to heat expansion in the sun. Therefore, slits 42 are provided at the bottom 104 of the joint member D along the longitudinal direction with the same distance as that of notches 40, 41 in the connecting extension 27 and 30 of the metal roof units C, C so that the slits 42 are placed exactly on the notches 40, 41 when the metal roof units C, C are joined together and the joint member D is mounted on the connecting extension 27 and 30 and fixed. In other words, the engaging members 106, 106 provided at the joint member D receive the vertical rising portions 29 and 26 of the neighbouring metal roof units C, C. Then nails are hammered into the rafter through said slits 42 provided at the bottom of the joint member D and through the notches 40, 41 provided at the end of the neighbouring metal roof units C, C in order to fix the metal roof units C, C onto the rafter. However, the metal roof units C, C are movable to some extent under the influence of sun heat by virtue of said slits and notches.

FIG. 9 shows a perspective view of a covering member 109 of the joint member D. The covering member 109 is also made of light metal such as aluminium by extrusion forming and provided with leg members 110, 110 at the bottom thereof. When the covering member 109 is mounted on the main body 102 of the joint member D, it just fits between the side walls 103, and when it extends up to the projecting pieces 107, the upper surface of the covering member 109 overlaps onto the flange 105. Also flanges 111 provided downwardly at each ends of the covering member 109 fit to the ends of the flange 105.

FIG. 10 shows a cross sectional view showing united ends of metal roof units C, C with joint member D. In order to unite the metal roof units C, C, at first the connecting extensions 27 and 30 of the neighbouring metal roof units are overlapped on the rafter 45. Then the joint member D is mounted on the uniting portions of the neighbouring metal roof units C, C so that the engaging members 106 provided in the joint member D embrace the vertical rising portions 26, 29 with bent tip 101, 101. Then nails are hit at optional intervals in the longitudinal direction from the bottom 51 to the rafter 45, and the covering member 109 is mounted on the joint member D. The bent tips 101, 101 of the vertical rising portions 26, 28 at each ends of the neighbouring metal roofs units C, C contact with corrugations 108 provided at the inner surface of the engaging member 106, 106, in the united states of those metal roof units C, C. Also the bent portions of the vertical rising portions 26, 28 towards bent tips 101, 101 contact with or closely approach to the under surfaces of the flange 105 of the joint member D. Therefore, the space between the inner surface of the joint member D and the vertical rising portions 26, 28 are narrowly limited at two places, in order to prevent the joint portion from penetration of rain or wind.

FIG. 12 is a perspective view showing the method of jointing metal roof unit C and the side metal roof unit A. First, the connecting extension 31 of the roof unit C and the connecting extension 3 (FIG. 2) are superimposed on the rafter. Then, the main body 102 of the joint member D is placed so that the engaging members 47 provided in the main body 102 embrace the vertical rising portion 29 of the metal roof unit C and the vertical rising portion 2 of the side roof unit A. Then, nails are hit at optional intervals in the longitudinal direction from the convexed portion 51 provided at the bottom 104 of the joint member D so as to fix the joint member D and the connecting extensions 31 and 3 of the metal roof C and the side metal roof unit A to the rafter. As the joint portion 11 of the eaves material 10 is superimposed on the joint portion 33 of the eaves material 31, nailing from the front downwardly bent portion of the eaves material 31 and 10 toward the rafter results in a complete joining of the two. The cap E shown in FIG. 1 is placed over the eaves portion of the joint member D connected as above so as to give a good appearance.

Construction of the ridge portion will now be described.

Referring to FIGS. 14 and 15, the ridge boards F are caused to ride over the joint members D, connected by means of a ridge connecting member 61 and covered with a ridge connecting cover G which is fixed by means of a connecting cover fixing member H.

First, at the joint portion of the ridge boards F, a nail 62 is driven into a ridge piece 63 from between the metal roof units C lying on the left and right sides of the ridge. A wire 64 is tied on the head of the nail 62. Projecting pieces 65 of the ridge connecting member 61 are inserted in grooves 66 for the ridge connecting member formed in the ridge board F. The wire 64 is passed through an inserting hole (not shown) of the ridge connecting member 61 to fasten it tightly thereto. In this state, the projecting pieces 65 of the ridge connecting member 61 fixed by the wire 64 are engaged with grooves 66 of the adjoining ridge board F and caused to slide. This results in the state shown in FIG. 12, and the ridge boards F are firmly fixed to the ridge piece 63.

The joint part of the ridge boards F is covered by a ridge connecting cover G. This cover G is placed over the joint part of the ridge boards F to prevent the intrusion of rainwater from the joint part. The cover G is formed to have the same angle as the ridge shape of the ridge boards F, and generally made by extrusion forming of an aluminum alloy.

To the inside surface of the ridge-shaped portion of the cover G, a rubber material, for example, is attached so that when it covers the ridge boards F, it completely prevents the intrusion of rainwater as a result of intimate adhesion. Projecting pieces 113 to be engaged with the connecting cover fixing member H are provided on both lower ends of the ridge-shaped connecting cover G, and raised and depressed portions are formed on the upper surface of the cover G.

Since the ridge connecting cover G would deviate to left and right, the cover is fixed by means of the connecting cover fixing member H slidably provided in the flanges 46 of the joint member D of the roof unit C. This fixing prevents the lateral movement of the cover G and also serves to render the fixing of the ridge boards F firmer.

In this way, the ridge boards F are successively connected to construct the ridge.

Since no joint member D is present at the end portions of the roof as is clear from FIG. 1, the end portions of the ridge should accordingly be made of a special structure.

FIG. 14 shows the end structure of the ridge; FIG. 15 is a cross sectional view of the ridge end material I taken along the line *b—b* of FIG. 14; and FIG. 16 is a cross sectional view taken along the line *c—c* of FIG. 14.

The ridge end material I is made of an aluminum alloy or the like formed in a ridge shape, and consists of two portions, $I_1$ and $I_2$. The portion $I_1$ covers the end of the ridge board F placed over the central part of the ridge, and the portion $I_2$ covers the end portion of the ridge which is not covered with the ridge board F.

In FIG. 15, the ridge end material I has a ridge-shaped cross section. Since the portion $I_1$ is placed on the upper portion of the ridge board F, it is larger in height than the portion $I_2$.

As can be seen from the cross sectional view of FIG. 16, the portion $I_1$ is ridge-shaped, and a sealing material such as rubber is attached to the inner surface of a top wall 70. Engaging notches 73 are formed on both side walls 72 near the joint portion of the portions $I_1$ and $I_2$. As will be described hereinbelow, the engaging notches 73 come into engagement with the flanges 46 of the joint member D for the roof units C and A and thus fix them, when the ridge end material I is to be fixed to the ridge.

As is shown in FIG. 16, the portion $I_2$ is formed in a ridge shape in the same way as the portion $I_1$, and includes a top wall 74 and parallel side walls 75. On the insides of the side walls 75, flanges 76 are provided in the longitudinal direction to support sealing material 77. The sealing materials 77 serve to prevent intrusion of rainwater by making close contact with the side metal roof unit A when the ridge end material I is secured to the ridge.

A notch 79 is provided in an end wall 78 of the portion $I_2$, and the lower end of the end wall 78 forms an inwardly extending flange 80. The notch 79 meshes with the flange portion 15 of the reinforcing material B and thus renders the fixing firm, when the ridge end material I is secured to the end of the ridge.

While the ridge end material I is moved slidingly from outside toward the side ridge portion of the roof already laid, the engaging notch 73 of the ridge end material I is engaged with the flange 46 of the joint member D located at the extreme end, and also the notch 79 of the ridge end material I is engaged with the flange 15 of the reinforcing material B, thereby to bring the ridge end material into intimate and firm contact with the roof. Then, a nail 82 is driven into the ridge piece 63 from the top of the ridge end material I to fix it.

The ridge end on the other side can likewise be worked using a ridge end material I′ having a structure symmetrical to the material I.

What is claimed is:

1. A metal roof construction comprising a metal roof unit which includes a backing, a surface metal plate having a series of notches therein and a heat insulating material disposed integrally between said backing and said surface metal; a joint member having a series of slits therein for jointing said surface metal plate of one said metal roof unit with a said surface metal plate of a neighbouring metal roof unit, by means of nails that are driven through said notches in said surface metal plate and said slits in said joint member into a rafter on which said metal roof unit is held at each fringe of said connecting extensions, said series of notches being located to coincide with another series of said notches provided at the fringe of a neighbouring one of said metal roof units so as to make said metal roof unit and said joint member movable due to heat expansion, said metal roof unit having a pair of vertical rising portions and connecting, extensions at each opposite ends, said connecting extensions of adjacent metal roof units being at least partially overlapped; and a covering member which covers said joint member.

2. A metal roof construction according to claim 1, wherein said joint member further comprises engaging members to engage with said vertical rising portions of said metal roof unit.

3. A metal roof construction according to claim 1 wherein said joint member has a corrugated surface and said pair of vertical rising portions of said metal roof unit have bent tips to contact with said corrugated surface of said joint member in order to prevent said metal roof from being penetrated by rain or wind.

4. A metal roof construction according to claim 1, wherein said covering member having legs and flanges to fit on said joint member.

* * * * *